United States Patent [19]

Donohue

[11] Patent Number: 4,909,729

[45] Date of Patent: Mar. 20, 1990

[54] AIR SLIDE FOR FUEL BURNERS

[76] Inventor: Patrick M. Donohue, 15 Julian Pl., Island Park, N.Y. 11558

[21] Appl. No.: 323,975

[22] Filed: Mar. 15, 1989

[51] Int. Cl.[4] ..... F23M 9/00

[52] U.S. Cl. ..... 431/188; 431/186

[58] Field of Search ..... 431/188, 186, 189; 239/406, 407, 412, 416.5; 92/117 A

[56] References Cited

U.S. PATENT DOCUMENTS

| | | | |
|---|---|---|---|
| 2,404,639 | 7/1946 | Lane | 92/117 A |
| 2,804,051 | 8/1957 | Lushansky | 92/117 A |
| 3,568,559 | 3/1971 | Fink | 92/117 A |

FOREIGN PATENT DOCUMENTS

| | | | |
|---|---|---|---|
| 1038487 | 8/1983 | U.S.S.R. | 92/117 A |

*Primary Examiner*—Randall L. Green

*Attorney, Agent, or Firm*—Brooks Haidt Haffner & Delahunty

[57] ABSTRACT

An improved arrangement of piston and cylinder assemblies for moving the air slides of fuel burners avoids build-up of combustion products on the piston. The cylinder is movable and the piston is fixed and located away from the burner so the cylinder can move toward and away from the burner on the piston to move the air slide.

6 Claims, 2 Drawing Sheets

AIR SLIDE FOR FUEL BURNERS

BACKGROUND OF THE INVENTION

1. Field of the Invention

The invention relates to an improved mechanism for translational movement of the air slide of an oil or gas burner.

2. Description of Related Art

Fuel burners such as the gas and oil burners made by Peabody Engineering Corporation of Stamford, Conn. are used in electric power generating plants. These burners typically have an air register, which comprises the section of the burner which contains and controls air flow by means of a venturi to increase the rate of flow of air entering the burner. Air entering the air register is divided into two streams by a conical plate, an inner stream passing through a diffuser which imparts a swirling motion to the air to mix the air with fuel and controls flow direction. So-called secondary air is most of the combustion air which follows the venturi contour of the register.

Combustion air is admitted to or excluded from the register by a tubular air slide, which is wide open when the burner is in use. The tubular air slide is movable on guide bars between the fully open position and a closed position, either manually or automatically by means of pneumatic piston and cylinder assemblies.

In automatic arrangements which employ pneumatic piston and cylnder assemblies, combustion products from the burning fuel can be deposited on the pistons of the air slide, and a build-up of such combustion products, which are sticky and hard to remove, can cause the pistons to jam in a fixed position, preventing movement of the air slide. This condition can cause damage to the burner in various ways, as for example by causing overheating of burner components, blowing back, and burning out, as will be understood by those acquainted with fuel burner maintenance. The present invention relates to avoiding the problems caused by combustion product deposition on the moving parts of air slide actuating piston and cylinder assemblies.

SUMMARY OF THE INVENTION

The piston and cylinder assemblies which are employed to move an air slide of an oil or gas burner are mounted at the front wall of a so-called windbox. A sticky combustion product escapes from the windbox and forms a hard-to-remove coating on moving parts such as the pistons and linking rods, which can interfere with piston motion and even cause the pistons to become stuck or frozen in one position. This requires prompt and expensive maintenance.

The present invention entails the reversal of the location of the piston and cylinder of the piston/cylinder assembly, so that the piston is located away from the windbox wall and is fixedly mounted while the cylinder is closer to the wall and is free to move back and forth to open and close the air slide. This reversal removes the face of the cylinder through which the piston projects, away from the windbox and thus from the combustion products which can otherwise cause the problem of interfering with operation of the piston/cylinder assembly. Existing burners can be inexpensively modified to obtain the benefits of the invention.

DETAILED DESCRIPTION OF A PREFERRED EMBODIMENT

Figure 1:
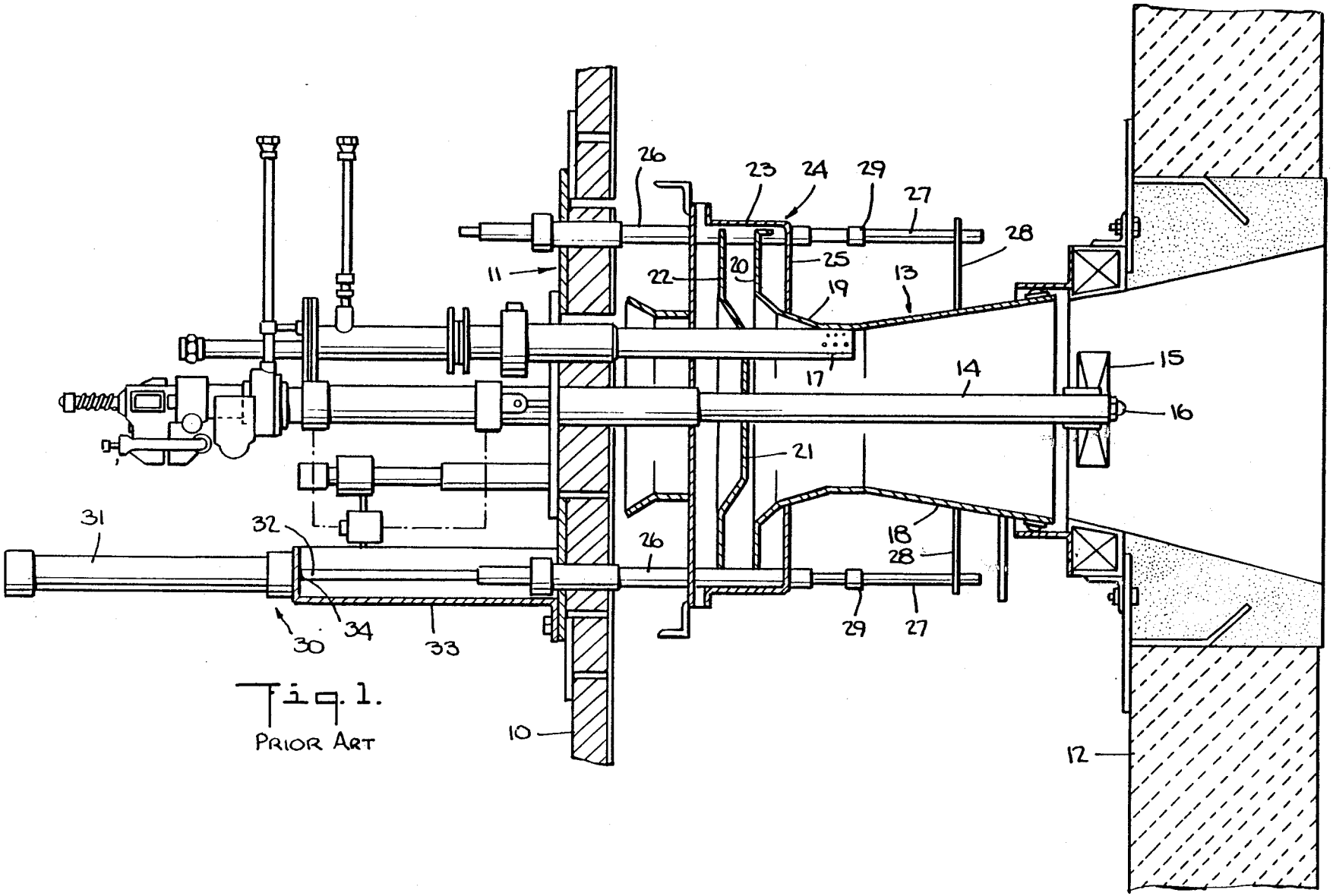
Fig. 1. PRIOR ART
FIG. 1 shows, in section, the prior art arrangement of a piston and cylinder for moving an air slide.

FIG. 1 illustrates a prior art gas or oil burner assembly in which reference numeral 10 designates the front wall of a windbox and reference numeral 11 generally designates a burner front wall plate which is secured to the windbox wall 10. The front plate 11 forms the base of a register and burner actuating mechanism. The boiler wall is generally indicated by reference numeral 12.

The operation of gas or oil burners is well understood by those of ordinary skill in the art. FIG. 1 shows the venturi 13 of the burner register surrounding a diffuser support tube 14 which passes centrally through the register. The support tube 14 terminates in a diffuser 15 which has an atomizer tip 16. Fuel is delivered via the diffuser 15 to be burned with air supplied via the register. An igniter is generally designated by reference numeral 17.

It can be seen in the drawings that the venturi 13 has a widening, generally conical forward portion 18, and a narrowing rear portion 19, which terminates in a toroidal flange 20. To the rear of the venturi 13, and mounted concentricaly with the venturi 13 is a dish-shaped plate 21 with a central aperture through which air enters the venturi 13. The plate 21 has a toroidal flange 22 parallel to the flange 20, and surrounding the space between the outer rims of the flanges 20 and 22 is the rearwardly extending lip 23 of a generally cylindrical air slide 24 which can be moved forward and back to open or close a passage for air between the flange 22 of the plate 21 and the flange 20.

The air slide 24 has a toroidal base portion 25 which is attached to reciprocally movable tubular members 26 slidably mounted on guide bars 27, the forward ends of which guide bars are bolted to plates 28 which are welded to the widening portion 18 of the venturi 13. Threaded nuts 29 on the guide bars adjustably limit the forward movement of the tubular members 26.

By moving the air slide 24 rearward to its closed position, the entry of combustion air into the burner is restricted. Movement of the air slide 24 can be accomplished manually, or by piston and cylinder assemblies which impart motion to the tubular members 26. Ordinarily there are two such tubular members 26 and two piston and cylinder assemblies (generally designated by reference numeral 30) located outside the burner front wall 11.

In the prior art arrangement shown in FIG. 1, the pneumatic power cylinder 31 which moves the piston 32 forward or back, is mounted on the windbox front wall 10 by means of a supporting member 33, shown as an angle iron within which the piston 32 is free to travel back and forth.

The forward end of the piston in FIG. 1 is secured to the tubular member 26 which is free to slide on the guide rod 27 in order to move the air slide 23 between its open and closed positions. A sleeve 34 is shown passing through the wall 10 and surrounding the tubular member 26 where it passes through the wall 10.

Combustion products resulting from the burning of fuel are deposited on the piston 32, and, because of motion of the piston 32, tend to build up at and near the place 34 where the piston 32 emerges from the cylinder 31. When this accretion of the sticky combustion products becomes significant the piston 32 is no longer free to move back and forth under the actuation of the pneumatic cylinder 31. This jamming of the pistons 32 can result in immobility of the air slide 23, causing serious burner operating problems, and requiring expensive maintenance, even the replacement of the piston/cylinder assembly.

Figure 2:
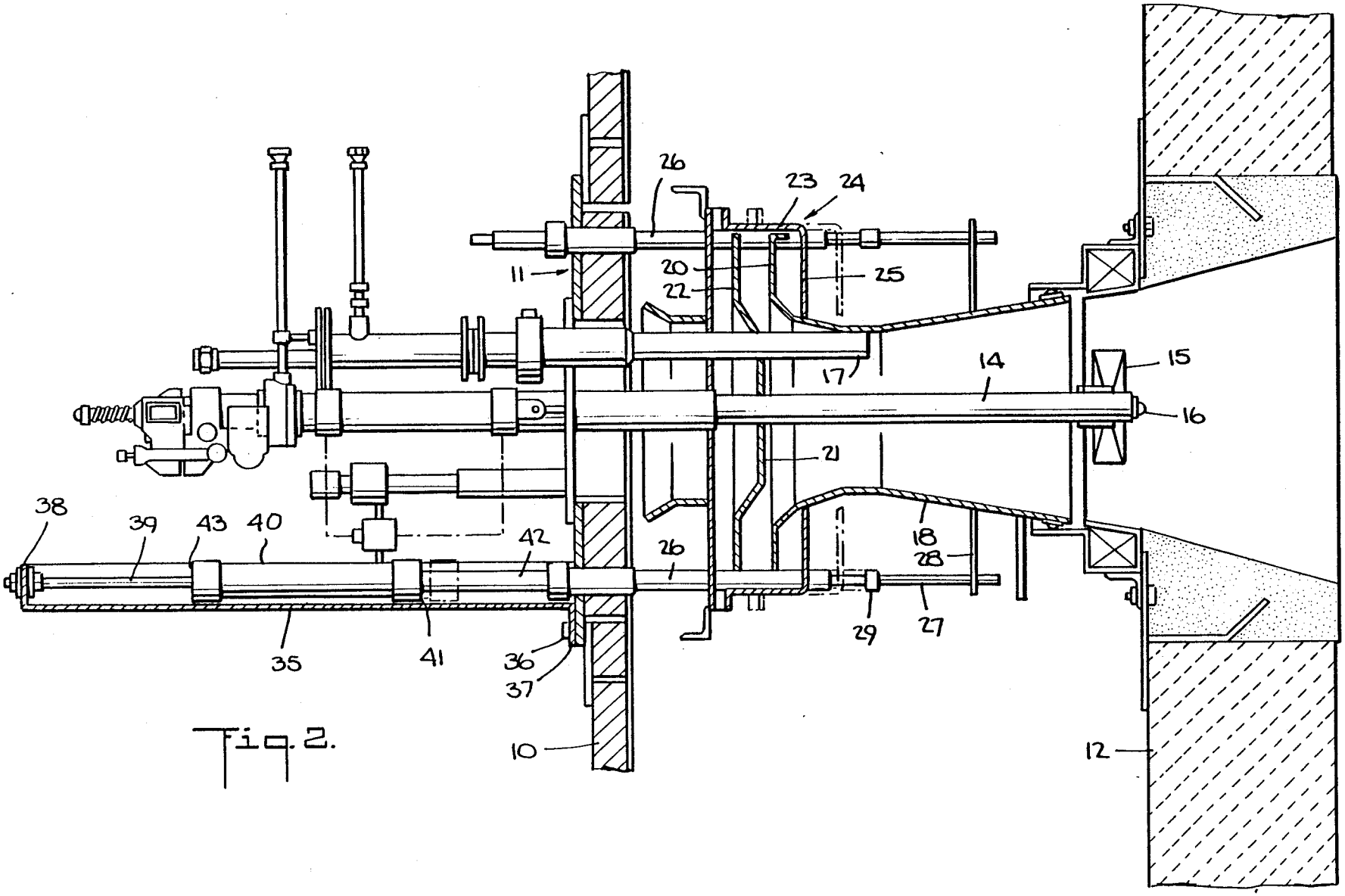
FIG. 2 is a view similar to that of FIG. 1, showing the improved piston and cylinder arrangement of the invention.

FIG. 2 illustrates the solution to this problem in accordance with the invention. In FIG. 2, the same reference numerals are used for parts illustrated in FIG. 1, which need not be described again.

The two tubular members 26, shown as diametrically spaced with respect to the venturi 13, are mounted on guide rods 27 as in the prior art illustration of FIG. 1, and, like the tubular members 26 of FIG. 1, they are automatically movable back and forth by pneumatic piston and cylinder assemblies.

In FIG. 2, a sturdy mounting bracket 35, which can be a section of angle iron, as shown, or any other rigid support strong enough to support the piston and cylinder, is secured by the bolt 36, which extends through a flange or lip 37 of the bracket, to the front wall plate 11 of the burner. The mounting bracket 35 extends perpendicularly to the wall 10 of the windbox in the horizontal direction, and at the end of the bracket remote from the windbox wall, there is an upstanding end plate 38, to which plate 38 the end of the piston 39 is secured.

The pneumatic cylinder 40 is mounted for sliding movement on the piston 39, toward or away from the wall 10 of the windbox, as shown in shadow lines in FIG. 2. The end 41 of the cylinder facing the windbox is connected either directly, or through a rigid linking member 42 as shown, to the tubular member 26. Flexible air lines (not shown) supply air under pressure to the pneumatic cylinders 40 to move them away from the end plates 38 and toward the front wall 10 of the windbox, thus moving the air slide 24 from the position shown in solid lines to the position shown in dot and dash lines in FIG. 2, to open a passage for secondary combustion air between the flange 20 of the venturi 13 and the dish shaped plate 21.

It will be seen that in the improved construction illustrated in FIG. 2, that the face 43 of the cylinder 40 through which the piston 39 passes, is spaced from the windbox wall 10 by a considerably greater distance than in the prior art arrangement of FIG. 1. Any combustion products escaping from the burner, which in the prior art arrangement would accrete on the piston 32, will tend to accrete harmlessly on the linking member 42 or on the body of the cylinder 40.

The cylinder 40 can thus ride smoothly on the piston 39 without the need for the frequent maintenance required by the prior art piston/cylinder arrangement shown in FIG. 1.

The improvement according to the present invention can easily and economically be incorporated in existing burner installations, with significant savings in maintenance costs. Various modifications, substitutions of parts and adaptations of the arrangement shown will suggest themselves to those familiar with the art and such modified arrangements are considered to be within the spirit and scope of the invention.

What is claimed is:

1. In combination with a fuel burner of the type having an air slide for regulating the flow of air entering the burner, a mechanism for moving the air slide comprising a piston and cylinder assembly mounted on a supporting bracket, the piston of said piston and cylinder assembly being fixed and the cylinder of the assembly being free to move, said cylinder being connected to the air slide for movement of the air slide so that a face of the cylinder through which the piston passes is directed away from and is more remote from said air slide than the cylinder connection to the air slide.

2. The mechanism of claim 1 wherein the piston and cylinder assembly is pneumatically operated.

3. The mechanism of claim 1 wherein the cylinder is connected to a tubular member which is attached to the air slide.

4. In combination with a fuel burner having a movable air slide, a pair of piston and cylinder assemblies for moving the air slide, each such assembly having a movable cylinder connected at one end to the air slide and a fixed piston entering a face of the cylinder directed away from the air slide at another end of the cylinder spaced from the end which is connected to the air slide.

5. The combination of claim 4 wherein the piston and cylinder assemblies ar mounted on horizontal mountings which extend from a wall of the burner.

6. The combination of claim 5 wherein the piston is secured at one end to the mounting.

* * * * *